US009719745B2

(12) United States Patent
Palu et al.

(10) Patent No.: US 9,719,745 B2
(45) Date of Patent: Aug. 1, 2017

(54) NOISE SUPPRESSOR FOR FIREARM

(71) Applicant: Thunder Beast Arms Corporation, Cheyenne, WY (US)

(72) Inventors: Kurtis A. Palu, Cheyenne, WY (US); Michael S. Coppinger, Cheyenne, WY (US)

(73) Assignee: Thunder Beast Arms Corporation, Cheyenne, WY (US)

( * ) Notice: Subject to any disclaimer, the term of this patent is extended or adjusted under 35 U.S.C. 154(b) by 0 days.

(21) Appl. No.: 14/816,321

(22) Filed: Aug. 3, 2015

(65) Prior Publication Data

US 2017/0038172 A1 Feb. 9, 2017

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 181/223; 89/14.4
See application file for complete search history.

(56) References Cited

U.S. PATENT DOCUMENTS

| | | | | |
|---|---|---|---|---|
| 4,576,083 | A | 3/1986 | Seberger, Jr. | |
| 4,907,488 | A | 3/1990 | Seberger | |
| 5,433,133 | A | 7/1995 | La France | |
| 6,308,609 | B1 * | 10/2001 | Davies | F41A 21/30 181/223 |
| 6,948,415 | B2 | 9/2005 | Matthews et al. | |
| 7,062,874 | B1 | 6/2006 | Smith | |
| 7,237,467 | B1 * | 7/2007 | Melton | F41A 21/30 89/14.4 |
| 7,308,967 | B1 | 12/2007 | Hoel | |
| D582,502 | S | 12/2008 | Brittingham | |
| D582,503 | S | 12/2008 | Brittingham | |
| D584,786 | S | 1/2009 | Brittingham | |
| D584,787 | S | 1/2009 | Brittingham | |
| D585,518 | S | 1/2009 | Brittingham | |
| D591,382 | S | 4/2009 | Brittingham | |
| 7,587,969 | B2 | 9/2009 | Silvers | |
| 7,588,122 | B2 | 9/2009 | Brittingham | |

(Continued)

FOREIGN PATENT DOCUMENTS

| | | |
|---|---|---|
| WO | WO 97/07375 A2 | 2/1997 |
| WO | WO 2011/035111 A1 | 3/2011 |

OTHER PUBLICATIONS

U.S. Appl. No. 14/615,826; Notice of Allowance dated Feb. 8, 2016; 18 pages.

(Continued)

*Primary Examiner* — Jeremy Luks
(74) *Attorney, Agent, or Firm* — Swanson & Bratschun, L.L.C.

(57) ABSTRACT

Novel noise suppressors to attach to firearms designed to minimize weight, maintain strength, increase accuracy, and improve usability. Disclosed embodiments include a blast chamber designed to withstand greater internal pressures than other suppressor components; a first baffle and spacer formed as a single component and subsequent baffles and spacers formed from separate components; a first baffle comprising a substantially semi-hemispherical dome and subsequent baffles comprising a substantially conical shape; and exterior bi-directional flutes formed on the exterior surface of the suppressor.

10 Claims, 5 Drawing Sheets

(56) References Cited

U.S. PATENT DOCUMENTS

| | | | |
|---|---|---|---|
| 7,594,464 | B2 | 9/2009 | Dueck |
| 7,600,606 | B2 | 10/2009 | Brittingham |
| 7,610,710 | B2 | 11/2009 | Brittingham |
| 7,610,992 | B2 | 11/2009 | Brittingham |
| 7,661,349 | B1 | 2/2010 | Brittingham |
| 7,676,976 | B2 | 3/2010 | Dueck et al. |
| 7,743,693 | B1 | 6/2010 | Brittingham |
| 7,789,009 | B1 | 9/2010 | Brittingham |
| 7,856,914 | B2 | 12/2010 | Shults et al. |
| 7,874,238 | B2 | 1/2011 | Silvers |
| 7,891,282 | B1 | 2/2011 | DeGroat |
| 7,905,171 | B1 | 3/2011 | Brittingham |
| 7,946,069 | B2 | 5/2011 | Dueck et al. |
| D639,375 | S | 6/2011 | Oliver |
| D642,648 | S | 8/2011 | Oliver |
| D642,649 | S | 8/2011 | Oliver |
| D642,650 | S | 8/2011 | Oliver |
| D643,087 | S | 8/2011 | Oliver |
| 7,987,944 | B1 | 8/2011 | Brittingham et al. |
| 8,087,338 | B1 | 1/2012 | Hines |
| 8,091,462 | B2 | 1/2012 | Dueck et al. |
| 8,096,222 | B2 | 1/2012 | Silvers |
| 8,100,224 | B1 | 1/2012 | Olson |
| 8,162,100 | B2 | 4/2012 | Shults et al. |
| 8,167,084 | B1 | 5/2012 | Moore |
| 8,196,701 | B1 | 6/2012 | Oliver |
| 8,201,487 | B2 | 6/2012 | Dueck et al. |
| 8,209,895 | B2 | 7/2012 | Dueck et al. |
| 8,272,306 | B1 | 9/2012 | Smith |
| 8,286,750 | B1 | 10/2012 | Oliver |
| D677,357 | S | 3/2013 | Dueck et al. |
| 8,387,299 | B1 | 3/2013 | Brittingham et al. |
| 8,397,862 | B2 | 3/2013 | Shand |
| 8,424,441 | B2 | 4/2013 | Brittingham et al. |
| D682,974 | S | 5/2013 | Honigmann |
| D682,975 | S | 5/2013 | Honigmann |
| 8,439,155 | B2 | 5/2013 | Shults et al. |
| D683,806 | S | 6/2013 | Dueck |
| 8,453,789 | B1 | 6/2013 | Honigmann et al. |
| 8,459,405 | B1 | 6/2013 | Dueck |
| 8,459,406 | B1 | 6/2013 | Dueck |
| 8,474,361 | B2 | 7/2013 | Brittingham |
| 8,490,535 | B1 | 7/2013 | Moore et al. |
| 8,505,431 | B2 | 8/2013 | Hines |
| 8,505,680 | B2 | 8/2013 | Dueck |
| 8,516,941 | B1 | 8/2013 | Oliver |
| 8,528,691 | B1 | 9/2013 | Carmichael et al. |
| 8,539,708 | B2 | 9/2013 | Kenney et al. |
| 8,555,765 | B2 | 10/2013 | Graham et al. |
| 8,567,556 | B2 | 10/2013 | Dueck et al. |
| 8,579,075 | B2 | 11/2013 | Brittingham et al. |
| 8,584,794 | B2 | 11/2013 | Dueck |
| 8,714,301 | B2 | 5/2014 | Shults |
| 8,739,922 | B2 | 6/2014 | Wirth et al. |
| 8,763,510 | B2 | 7/2014 | Dueck et al. |
| 8,770,084 | B2 | 7/2014 | Young |
| 8,826,793 | B2 | 9/2014 | Oliver |
| 8,881,862 | B1 | 11/2014 | Messer, Jr. et al. |
| 8,939,057 | B1 | 1/2015 | Edsall |
| 8,950,310 | B2 | 2/2015 | Storrs |
| 8,950,546 | B2 | 2/2015 | Shults et al. |
| 8,973,481 | B2 | 3/2015 | Dueck et al. |
| 8,991,551 | B2 | 3/2015 | Latka |
| 9,194,640 | B2 | 11/2015 | Wirth et al. |
| 9,291,417 | B2 | 3/2016 | James |
| 9,316,456 | B1 | 4/2016 | Oliver |
| 9,366,495 | B1 | 6/2016 | Coppinger et al. |
| 9,593,899 | B2 | 3/2017 | Coppinger et al. |
| 2012/0103176 | A1 | 5/2012 | Latka |
| 2012/0272818 | A1 | 11/2012 | Dueck et al. |
| 2013/0180796 | A1* | 7/2013 | Dueck ..... F41A 21/30 181/223 |
| 2014/0059913 | A1* | 3/2014 | Diamond ..... F41C 27/00 42/90 |
| 2014/0262605 | A1 | 9/2014 | Washburn, III et al. |
| 2014/0318887 | A1* | 10/2014 | Latka ..... F41A 21/30 181/223 |
| 2016/0109205 | A1 | 4/2016 | Coppinger et al. |

OTHER PUBLICATIONS

U.S. Appl. No. 14/640, NonFinal Office Action dated Jul. 11, 2016; 21 pages.

U.S. Appl. No. 14/640, Notice of Allowance dated Oct. 31, 2016; 13 pages.

* cited by examiner

NOISE SUPPRESSOR FOR FIREARM

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to a firearm noise suppressor designed to minimize weight, maintain strength, increase accuracy, and improve usability. More particularly, the novel noise suppressor comprises one or more features including a blast chamber designed to withstand greater internal pressures than other suppressor components; a first baffle and spacer formed as a single component and subsequent baffles and spacers formed from separate components; a first baffle comprising a substantially semi-hemispherical dome and subsequent baffles comprising a substantially conical shape; and bi-directional flutes formed on the exterior surface of the suppressor.

BACKGROUND

In order to fire a projectile, a firearm utilizes an ignited propellant to create a high-pressure pulse of hot gases behind the projectile to force the projectile down the barrel of the firearm. When the high-pressure gases exit the barrel of the firearm, they generate a loud noise, commonly referred to as a "muzzle blast." Noise suppressors are commonly used with firearms, such as rifles and handguns, to reduce muzzle blast. To reduce muzzle blast, suppressors attach to the end of the firearm barrel and allow the high-pressure gases to expand, and thereby dissipate pressure, before exiting the firearm. By allowing the pressure behind the projectile to dissipate before exiting the firearm, a firearm suppressor can significantly reduce muzzle blast.

In order to allow the high-pressure gases to expand before exiting the firearm, a noise suppressor creates a significantly larger volume than exists in the firearm barrel. Noise suppressors can create this larger volume through a series of chambers, which are often referred to as "baffles" that are separated by "spacers," and a blast chamber between the end of the firearm barrel and the first baffle. As the projectile exits the firearm barrel, significant high-pressure gases expand into the blast chamber and subject the proximal end of the noise suppressor to significant internal pressure. As the gases expand through the noise suppressor, the gases from the firearm begin to dissipate as they proceed through the blast chamber and into the series of baffles. As a result, the pressure exerted on the interior of the noise suppressor decreases from the proximal end to the distal end of the noise suppressor. However, current noise suppressors are designed to withstand the same internal pressure throughout the suppressor, regardless of the length of the suppressor, and do not account for the disparity of internal pressure between the proximal and distal ends of the suppressors.

By way of example, in current noise suppressors, the blast chamber is commonly designed with the same material and thickness as each of the baffles and spacers. Such suppressors are designed to withstand a maximum pressure throughout the suppressor even though the suppressor only experiences this maximum pressure at its proximal end. As a result, current noise suppressors are not ideally optimized to both decrease weight and maintain the necessary strength to withstand the maximum pressure at the proximal end of the suppressor. This causes such suppressors to be needlessly heavy, which negatively impacts their accuracy and other performance indicators.

By way of further example, in many current noise suppressors, the first baffle and spacer have the same design as the subsequent baffles and spacers even though the high-pressure gases exert a significantly higher force on the proximal end of the first baffle than on the proximal end of each subsequent baffle. For example, certain current noise suppressors are designed with the same baffles separated by spacers throughout the suppressor. Such designs are common because, in part, they are easier to design and manufacture. However, because the internal pressure within a suppressor is greatest on the proximal face of the first baffle, noise suppressors with a first baffle and spacer can experience accuracy problems over time as the alignment of the first baffle and spacer worsen due to the significant pressure experienced on the interface between the first baffle and spacer. Noise suppressors can be designed to address these accuracy problems by combining each baffle and spacer in a single component. However, while such a design potentially addresses the alignment problem created by the high pressure experienced on the proximal face of the first baffle, this design is harder and more expensive to manufacturer and unnecessary for subsequent baffles and spacers that experience less internal pressure. As a result, the baffle and spacer designs of current suppressors are not designed so that the first baffle and spacer are designed to specifically address the issues caused by the initial pressure on the proximal face of the first baffle while ensuring that the remaining baffles and spacers are designed to optimize manufacturing and cost considerations.

Lastly, current noise suppressors typically have a smooth exterior surface, which creates several issues that negatively impact usability. For example, noise suppressors with a smooth exterior surface can be difficult for the user to grip both when attaching the suppressor before use and detaching the suppressor after use. In addition, noise suppressors with a smooth exterior surface often retain heat for a significant amount of time after use, which can make it difficult for the user to remove the noise suppressor from the firearm after use.

Accordingly, there is a need for a noise suppressor designed with increased usability that minimizes weight and increases accuracy, while still possessing the necessary strength to accommodate the maximum internal pressure created from the muzzle blast.

BRIEF SUMMARY

Certain embodiments include a firearm noise suppressor designed to minimize weight, maintain strength, increase accuracy, and improve usability as well as tools and techniques to create the same.

In an aspect of particular embodiments, a noise suppressor comprises a blast chamber with walls that have a greater thickness than the walls of the baffles and spacers. Such embodiments ensure that the blast chamber can withstand the maximum internal pressure created from the discharge of the firearm while also ensuring that the baffles and spacers, which do not have to withstand the same internal pressure as the blast chamber, have thinner walls to reduce the overall weight of the suppressor. Similarly, in other aspects of particular embodiments, the blast chamber and, in some cases, the first baffle and spacer are made of a first material and other spacers are made of a second material. For example, in certain embodiments, the blast chamber and first baffle and spacer are made of titanium grade 5 and the remaining spacers are made of titanium grade 9. Titanium grade 9 does not have same strength as titanium grade 5, but titanium grade 9 is lighter, less expensive, and easier to use in manufacturing than titanium grade 5. Therefore, particular embodiments include noise suppressors designed to withstand the maximum internal pressure, but further optimized for weight and other beneficial considerations, including reduced cost and ease of manufacture.

In certain embodiments, a noise suppressor comprises a first baffle and spacer formed of a single component and subsequent baffles and spacers formed from separate components. In other words, in certain embodiments, the first baffle and spacer form a single unit that cannot be separated even when the noise suppressor is disassembled. Moreover, in certain embodiments, the first baffle is formed with a substantially semispherical dome and subsequent baffles are formed with a substantially conical shape. Forming the first baffle and spacer as a single component, and forming the first baffle with a substantially hemispherical dome, increases the strength of the first baffle and allows the proximal face of the first baffle to withstand the significant internal force exerted on the baffle from the discharge of the firearm. In addition, subsequent baffles, which do not have to withstand the same internal force as the first baffle, are formed with a substantially conical shape and as separate components from the spacers. In other words, the subsequent baffle and spacers are separate components that can be separated when the noise suppressor is disassembled. This design makes the subsequent baffles and spacers easier to manufacture and assemble.

In certain embodiments, a noise suppressor comprises an exterior surface with bi-directional flutes. Such bi-directional flutes further reduces the weight of the noise suppressor and improve the usability of the suppressor by improving the ability of the user to grip the noise suppressor to attach the noise suppressor before use and detach the suppressor after use. In addition, the bi-directional flutes increase the surface area of the suppressor that allows the suppressor to more easily cool after use.

The embodiments of the invention described herein are defined by the claims. Further advantages and a more complete understanding of the embodiments will be apparent to persons skilled in the art from review following a detailed description of various embodiments and appended claims.

BRIEF DESCRIPTION OF THE DRAWINGS

A further understanding of the nature and advantages of particular embodiments may be realized by reference to the remaining portions of the specification and the drawings, in which like reference numerals are used to refer to similar components.

DETAILED DESCRIPTION OF CERTAIN EMBODIMENTS

While various aspects and features of certain embodiments have been summarized above, the following detailed description illustrates a few exemplary embodiments in further detail to enable one of skill in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present inventions may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers used herein to express quantities, dimensions, and so forth should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

Figure 1:
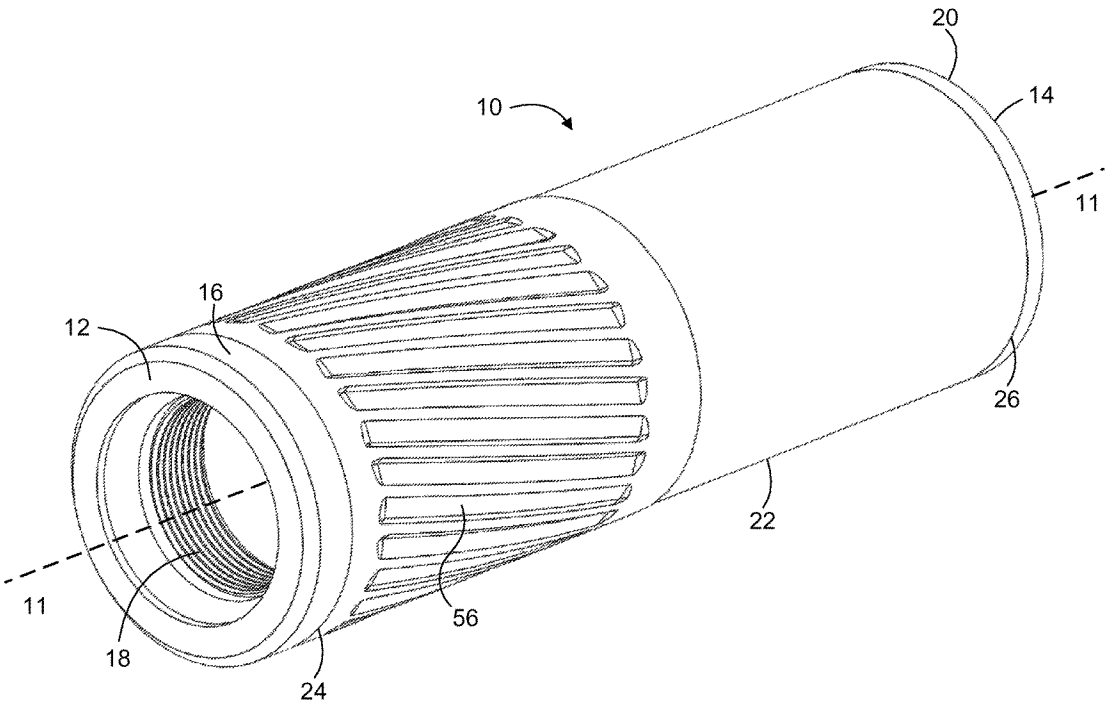
FIG. 1 shows a perspective view of an embodiment of the present invention.

FIG. 1 is a perspective view of an exemplary noise suppressor 10 in accordance with an embodiment of the present invention. As shown, the suppressor 10 includes central axis 11, a proximal end 12, and a distal end 14. As used in this detailed description, the term "proximal" is used to refer to the end of the component or element closest to a barrel of a firearm and the term "distal" is used to refer to the end of the component or element farthest from the barrel of the firearm. Suppressor 10 includes a proximal end cap 16 that attaches to a muzzle break located on the barrel of the firearm. In other embodiments, the proximal end cap can be modified to either connect to a flash suppressor or other device that attaches to the barrel of a firearm, or to connect directly to the barrel of the firearm. In this embodiment, the proximal end cap attaches to a muzzle break located on the barrel of a firearm (which is not shown) using a threaded interface 18. Suppressor 10 also includes a distal end cap 20 and outer tube 22. In this embodiment, outer tube 22 attaches to proximal end cap 16 and distal end cap 20 at interfaces 24 and 26, respectively. In this embodiment, the outer tube 22 has exterior bi-directional flutes 56.

Figure 2:
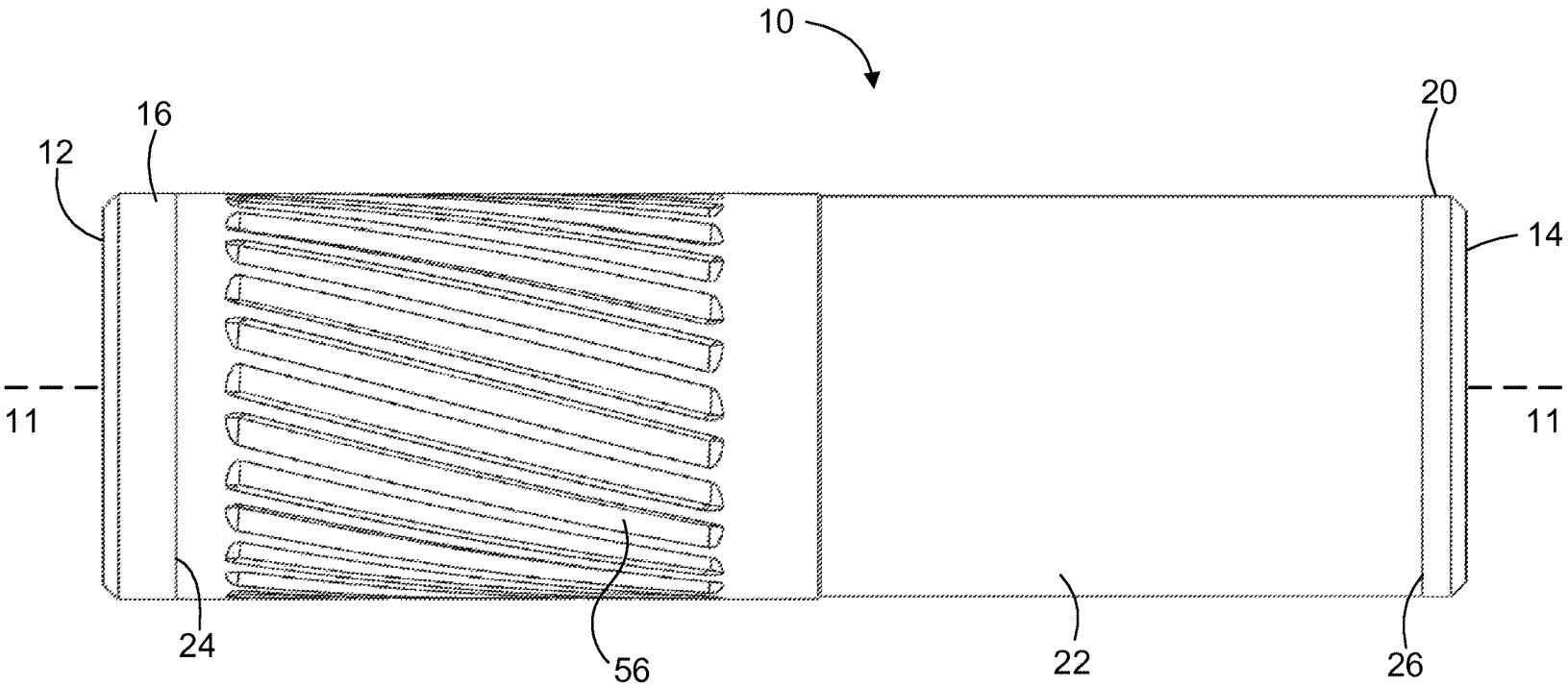
FIG. 2 shows a side view of an embodiment of the present invention.

FIG. 2 is a side view of the noise suppressor 10 as shown in FIG. 1.

Figure 3:
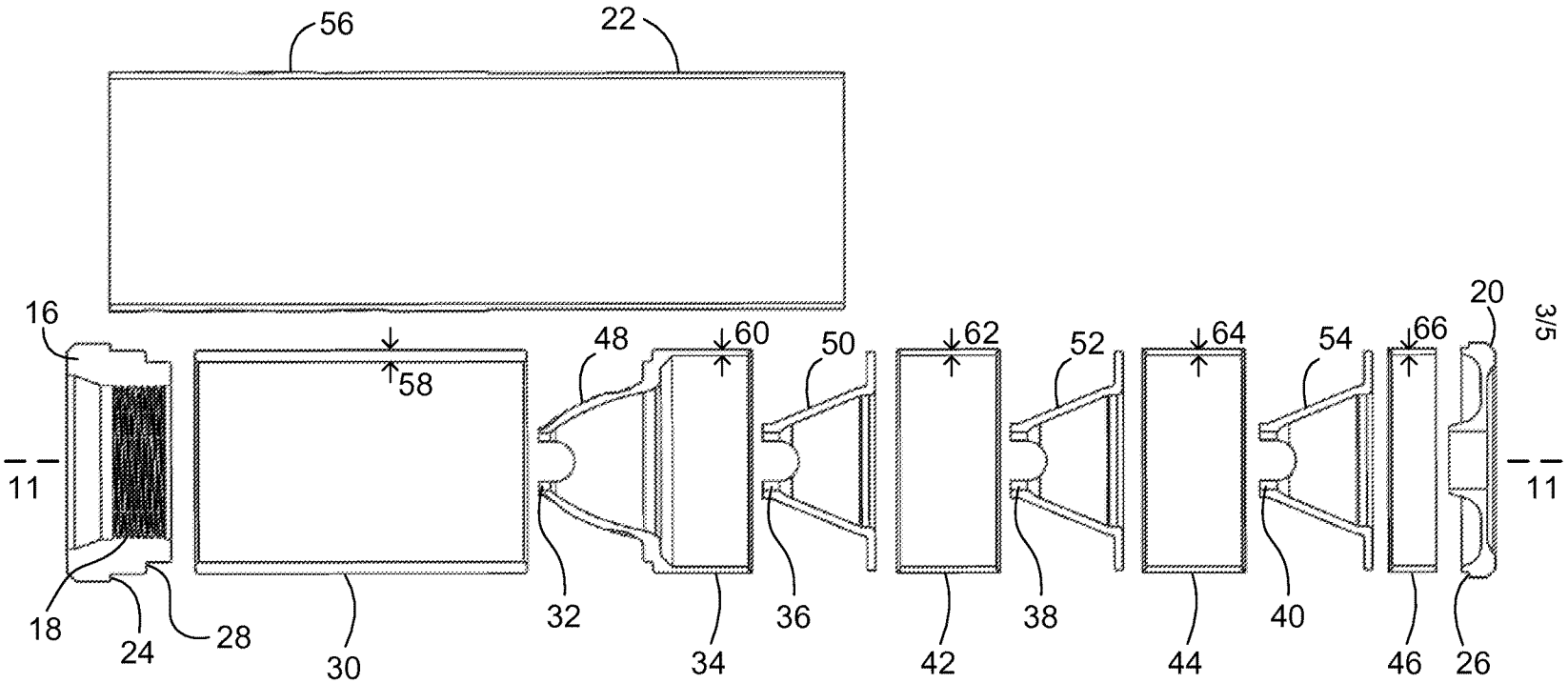
FIG. 3 shows an exploded cross sectional side view of the noise suppressor of FIGS. 1 and 2 with the outer tube removed.
Figure 4:
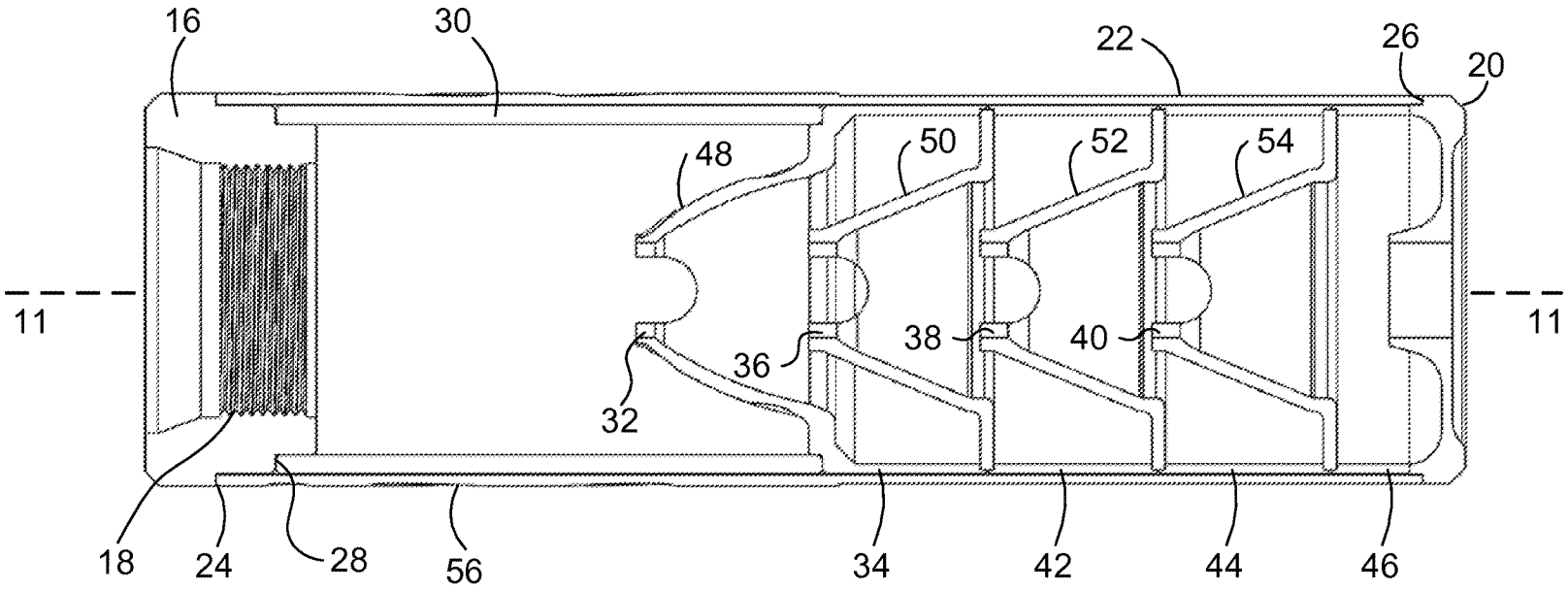
FIG. 4 shows a cross sectional side view of the noise suppressor of FIGS. 1-3.
Figure 5:
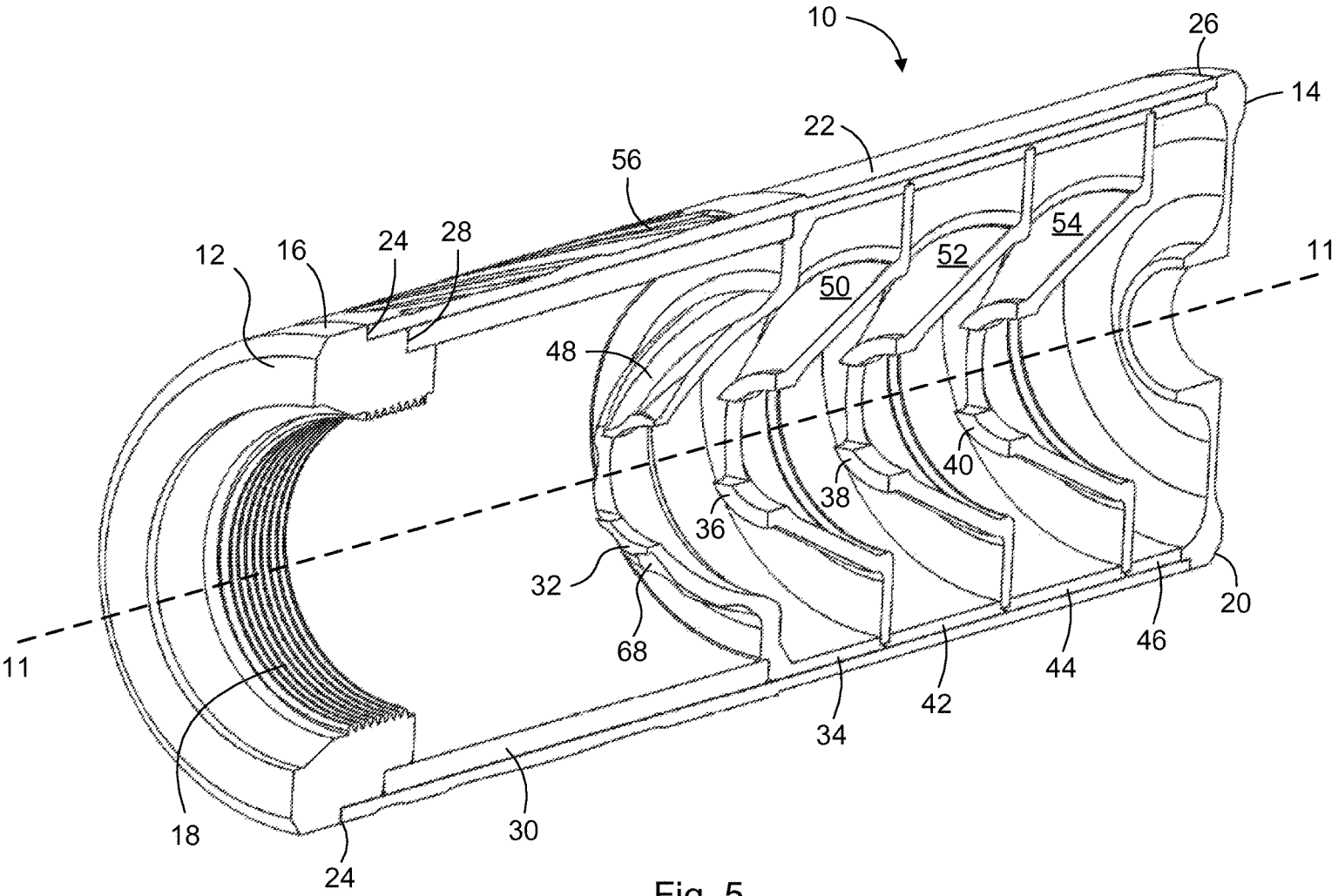
FIG. 5 shows a cross sectional view of the noise suppressor of FIGS. 1-4.

FIG. 3 is an exploded cross sectional side view of noise suppressor 10 as shown in FIGS. 1 and 2 with outer tube 22 removed. FIG. 4 shows a cross sectional side view of noise suppressor 10 as shown in FIGS. 1-3. FIG. 5 shows a cross sectional view of noise suppressor 10 as shown in FIGS. 1-4. As shown in FIGS. 3-5, in this embodiment, the components of noise suppressor 10 are aligned along central axis 11 wherein each component has a bore at its proximal end aligned with central axis 11. Proximal end cap 16 includes threaded interface 18, which attaches to the muzzle of the barrel of the firearm that is not shown. Proximal end cap 16 also includes interface 24 where outer tube 22 attaches to proximal end cap 16. Proximal end cap 16 also includes internal interface 28. As shown in FIGS. 3-5, noise suppressor 10 in this embodiment also includes a blast chamber 30 that attaches at its proximal end to internal interface 28. In this embodiment, noise suppressor 10 includes a first baffle 32 that is formed as a single component with spacer 34. Noise suppressor 10 also comprises second, third, and fourth baffles 36, 38, and 40, respectively, as well as second, third, and fourth spacers 42, 44, and 46, respectively. First baffle 32 further comprises a semi-hemispherical dome 48. Second baffle 36 further comprises a conical shape 50. Third baffle 38 further comprises a conical shape 52. Fourth baffle 40 further comprises a conical shape 54.

As shown in FIG. 3, the blast chamber 30 has a wall thickness 58. Spacers 34, 42, 44, and 46 have wall thicknesses of 60, 62, 64, and 66, respectively. Because the internal pressure created from the discharge of the firearm is greatest in the blast chamber 30, the wall thickness for blast chamber 30 is thicker than the wall thickness for spacers 34, 42, 44, and 46. In certain embodiments, the wall thickness of the blast chamber 30 is approximately 0.072 inches for a noise suppressor 10 that is approximately 5 inches in length and designed for a 30 caliber firearm. In comparison, the wall thickness for certain spacers 42, 44, and 46 is approximately 0.035 inches.

In other embodiments, blast chamber 30, baffle 32 (comprising semi-hemispherical dome 48) and spacer 34 are made of titanium grade 5 and spacers 42, 44, and 46 are made of titanium grade 9. Such embodiments utilize titanium grade 5, which is stronger than titanium grade 9, in blast chamber 30, baffle 32, and spacer 34 in order to withstand the maximum internal pressure created from the discharge of the firearm within blast chamber 30 and asserted on the proximal face of baffle 32, which comprises semi-hemispherical dome 48. Further, such embodiments, utilize titanium grade 9, which is lower in cost and easier to manufacture than titanium grade 5, in spacers 42, 44, and 46 in order to reduce the weight of noise suppressor 10. Titanium grade 5 and titanium grade 9 are defined by certain standard setting organizations such as the American Iron and Steel Institute ("AISI"), American Society of Testing and Materials ("ASTM"), or the Society of Automotive Engineers ("SAE").

As further shown in FIGS. 3-5, baffle 32 (comprising semi-hemispherical dome 48) and spacer 34 are made of a single component. Because baffle 32 abuts blast chamber 30, the maximum internal pressure in blast chamber 30 applies significant pressure to the proximal face of baffle 32, which comprises semi-hemispherical dome 48, as well as spacer 34. By making baffle 32 and spacer 34 a single component helps ensure that, among other things, baffle 32 and spacer 34 do not become misaligned during use. The misalignment of baffles and spacers can create a number of performance issues, including a reduction in accuracy. In contrast, because the internal pressure is less significant towards the distal end of noise suppressor 10, baffles 36, 38 and 40 and spacers 42, 44, and 46 are each separate components, which are easier to manufacture.

In other embodiments, the baffle 32 comprises a substantially semi-hemispherical dome 48. In contrast, baffles 36, 38, and 40 have substantially conical shapes 50, 52, and 54. The semi-hemispherical dome 48 provides greater strength than conical shapes 50, 52, and 54. In other embodiments, semi-hemispherical dome 48 also has helical flutes 68 as shown in FIG. 5.

In certain embodiments, the outer tube 22 of noise suppressor 10 further comprises exterior bi-directional flutes 56. In this particular embodiment, the bi-directional flutes 56 form a trench-like cut in outer tube 22 and extend in a curved manner over a portion of outer tube 22. In other words, the bi-directional flutes 56 extend in more than one direction over a portion of outer tube 22. Bi-directional flutes 56 further reduce the weight of noise suppressor 10 and improve the usability of the suppressor by improving the ability of the user to grip the noise suppressor to attach the noise suppressor before use and detach the suppressor after use. In addition, bi-directional flutes 56 increase the surface area of outer tube 22, which allows noise suppressor 10 to cool more quickly after use than prior art noise suppressors.

While various embodiments of apparatus are described with—or without—certain features for ease of description and to illustrate exemplary aspects of those embodiments, the various components and/or features described herein with respect to a particular embodiment can be substituted, added, and/or subtracted from among other described embodiments, unless the context dictates otherwise. Consequently, although several exemplary embodiments are described above, it will be appreciated that the invention is intended to cover all modifications and equivalents within the scope of the following claims.

What is claimed is:

1. A suppressor for a firearm comprising:

a central axis;

an outer tube comprising a proximal end and a distal end and bi-directional exterior flutes extending over a portion of the outer tube;

a blast chamber wherein the blast chamber comprises:
- a first material comprising a first wall thickness;
- a proximal end; and
- a distal end;

a proximal end cap wherein the proximal end cap comprises:
- a first interface to attach the proximal end cap to the outer tube;
- a proximal end adapted to be coupled to a firearm;
- a second interface to attach the proximal end cap to the blast chamber; and
- a bore aligned with the central axis;

a first baffle wherein the first baffle comprises:
- a proximal end;
- a distal end;
- a substantially hemispherical dome at the proximal end of the first baffle wherein the substantially hemispherical dome further comprises helical flutes;
- a bore in the substantially hemispherical dome of the first baffle aligned with the central axis; and
- a first spacer at the distal end of the first baffle wherein the first spacer and the first baffle form a single component comprising the first material wherein the first spacer further comprises a second wall thickness;

a second baffle wherein the second baffle comprises:
- a proximal end;
- a distal end;

a substantially conical shape at the proximal end of the second baffle; and a bore in the substantially conical shape of the second baffle aligned with the central axis;

a second spacer located adjacent to the distal end of the second baffle further comprising a third wall thickness wherein the second spacer comprises a second material and the second baffle and second spacer form separate components;

a distal end cap wherein the distal end cap comprises:

a bore aligned with the central axis; and a third interface wherein the third interface is connected to the distal end of the outer tube; and wherein the first wall thickness is greater than the second wall thickness and the third wall thickness.

2. The suppressor of claim 1, wherein the first material is a different material from the second material.

3. The suppressor of claim 1, wherein the first material comprises titanium grade 5.

4. The suppressor of claim 2, wherein the second material comprises titanium grade 9.

5. The suppressor of claim 4, wherein the first wall thickness is more than twice as thick as the second wall thickness.

6. The suppressor of claim 4, wherein the first wall thickness is more than twice as thick as the third wall thickness.

7. A suppressor for a firearm comprising:

a proximal end adapted to be coupled to a firearm;

a distal end opposite the proximal end;

a central axis aligned with a bore of the firearm;

a blast chamber comprising a first continuous, uniform surface around the central axis and a first wall thickness at the midsection of the blast chamber;

a first baffle comprising a first spacer wherein the first spacer comprises a second continuous, uniform surface around the central axis and a second wall thickness at the midsection of the first spacer;

a second spacer comprising a third continuous, uniform surface around the central axis and a third wall thickness at the midsection of the second spacer;

wherein the first thickness at the midsection of the blast chamber is greater than the second wall thickness at the midsection of the first spacer and third wall thickness at the midsection of the second spacer;

a second baffle, wherein the blast chamber and the first baffle comprise a first material and the second spacer comprises a second material;

wherein the first material is a different material from the second material; and wherein the first material can withstand a higher maximum internal pressure than the second material.

8. The suppressor of claim 7, wherein the second material has smaller weight per unit volume than the first material.

9. A suppressor for a firearm comprising:

a proximal end adapted to be coupled to a firearm;

a distal end opposite the proximal end;

a central axis aligned with a bore of the firearm;

a first baffle comprising a proximal end having a substantially semi-hemispherical dome and a first spacer wherein the first baffle and first spacer form a single component;

a second baffle comprising a proximal end having a substantially conical shape;

a second spacer; and wherein the second spacer and second baffle form separate components; and wherein the substantially semi-hemispherical dome further comprises helical flutes.

10. A suppressor for a firearm comprising:

a proximal end adapted to be coupled to a firearm;

a distal end opposite the proximal end;

a central axis aligned with a bore of the firearm;

a first baffle comprising a substantially semi-hemispherical dome;

a second baffle comprising a substantially conical shape;

wherein the first baffle is different in shape from the second baffle; and wherein the substantially semi-hemispherical dome further comprises helical flutes.

* * * * *